US008264136B2

(12) United States Patent
Yun

(10) Patent No.: US 8,264,136 B2
(45) Date of Patent: Sep. 11, 2012

(54) FLUORESCENT LAMP HAVING CERAMIC-GLASS COMPOSITE ELECTRODE

(75) Inventor: Man Sun Yun, Cheongju (KR)

(73) Assignees: Inova Inc., Chungbuk (KR); Santoma Ltd., Kowloon (HK)

( * ) Notice: Subject to any disclaimer, the term of this patent is extended or adjusted under 35 U.S.C. 154(b) by 511 days.

(21) Appl. No.: 12/450,765

(22) PCT Filed: May 15, 2007

(86) PCT No.: PCT/KR2007/002384

§ 371 (c)(1),
(2), (4) Date: Oct. 13, 2009

(87) PCT Pub. No.: WO2008/130071

PCT Pub. Date: Oct. 30, 2008

(65) Prior Publication Data

US 2010/0102705 A1 Apr. 29, 2010

(30) Foreign Application Priority Data

Apr. 20, 2007 (KR) ..... 10-2007-0038723

(51) Int. Cl.
*H01J 61/06* (2006.01)
*H01J 61/30* (2006.01)

(52) U.S. Cl. ..... 313/491; 313/234; 313/492; 313/633

(58) Field of Classification Search ..... 313/234, 313/491–493, 607, 621, 622, 631, 633
See application file for complete search history.

(56) References Cited

U.S. PATENT DOCUMENTS 5,013,966 A * 5/1991 Saikatsu et al. ..... 313/493
2003/0034735 A1 * 2/2003 Rausenberger et al. ..... 313/607

FOREIGN PATENT DOCUMENTS

JP 2004241189 A * 8/2004
WO WO 2007119911 A1 * 10/2007

* cited by examiner

*Primary Examiner* — Anh Mai
*Assistant Examiner* — Nathaniel Lee
(74) *Attorney, Agent, or Firm* — Rosenberg, Klein & Lee

(57) ABSTRACT

Disclosed is a fluorescent lamp having ceramic-glass composite electrodes, which has a higher dielectric constant, higher secondary electron emission, and higher polarization under the same electric field, and thus enables the movement of many more electrons and cations, resulting in high brightness. The fluorescent lamp having ceramic-glass composite electrodes includes a glass tube, which has a phosphor applied on the inner surface thereof and is filled with a mixture of inert gas and metal vapor, both ends of which are sealed; and hollow cylindrical electrodes provided at both ends of the glass tube, each of the hollow cylindrical electrodes having a stepped portion between a central portion thereof and an end portion thereof, and being formed of a ceramic-glass composite. As the material for the electrode, a composite, including a CaO—MgO—SrO—$ZrO_2$—$TiO_2$ ceramic composition and glass frit, is used.

10 Claims, 4 Drawing Sheets

[Fig. 1]
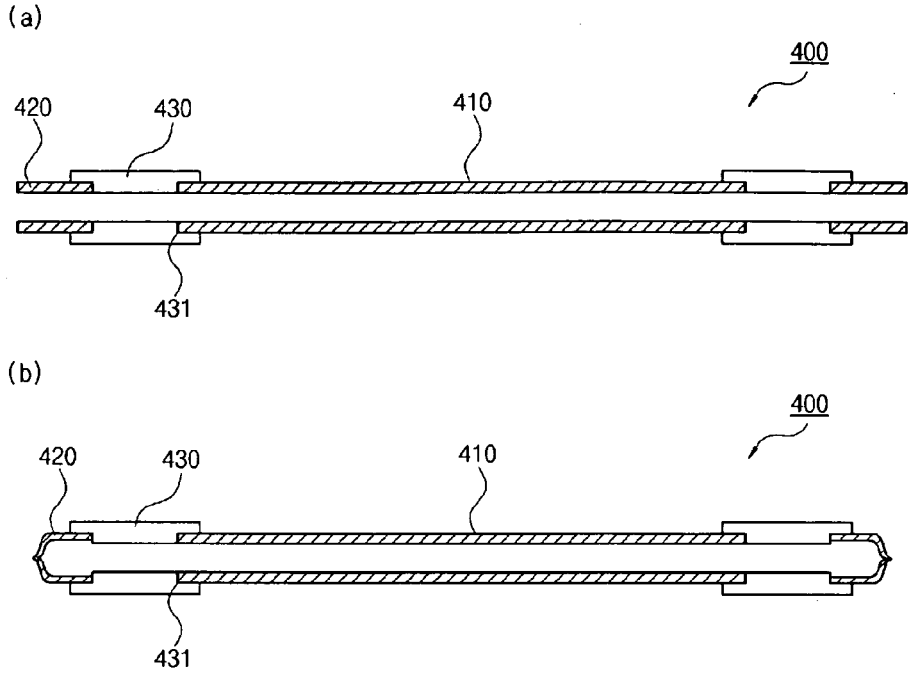
[Fig. 2]
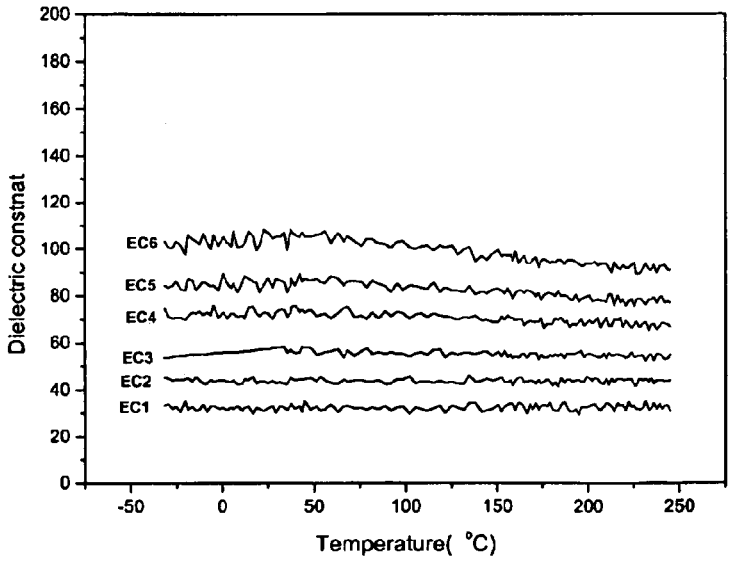

[Fig. 3]
(a)
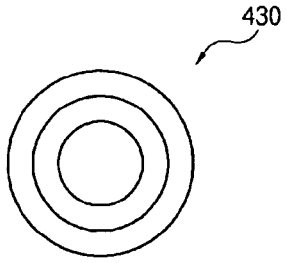
(b)
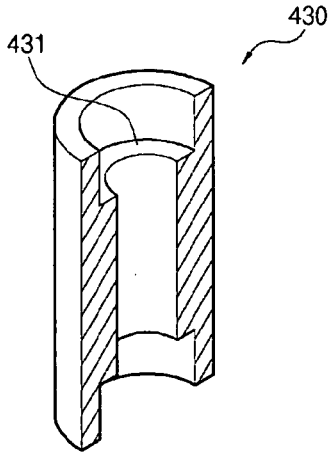
[Fig. 4]
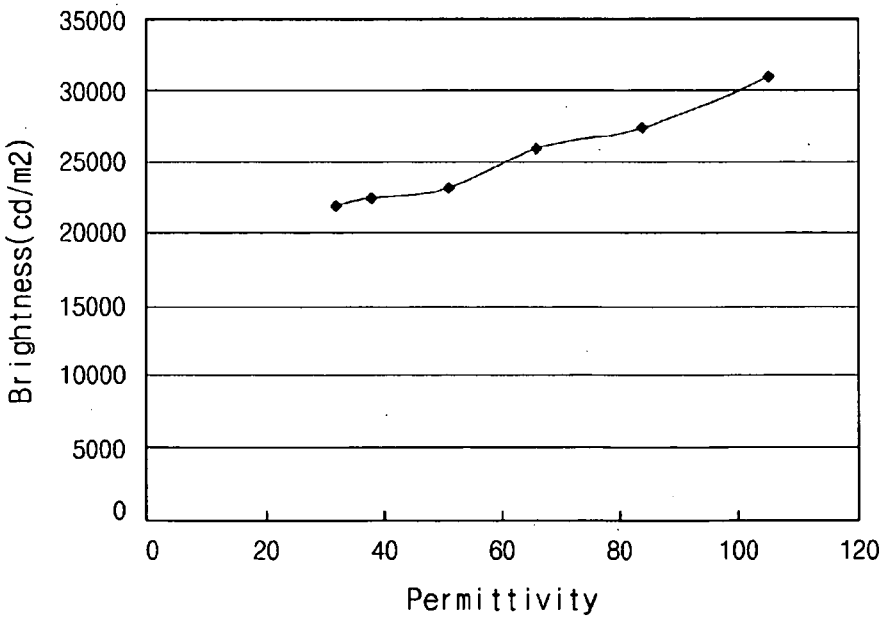

[Fig. 5]
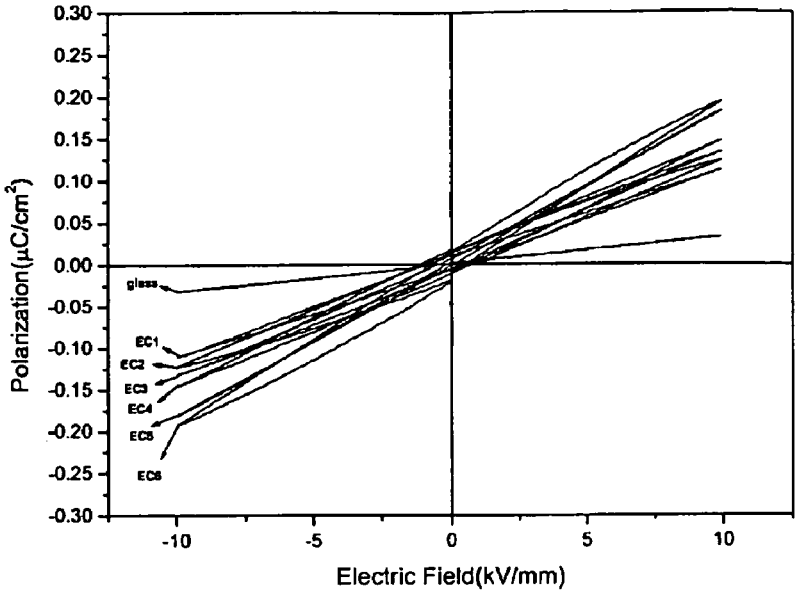
[Fig. 6]
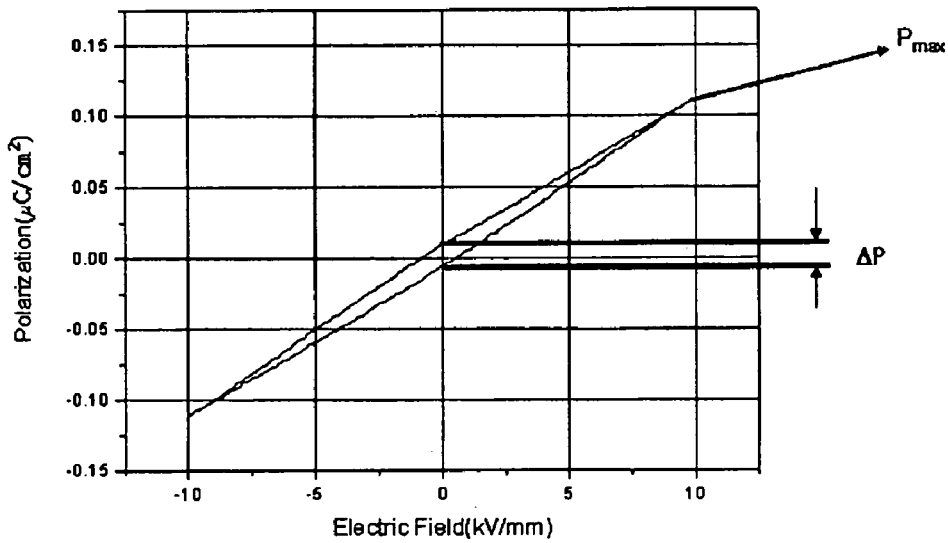
[Fig. 7]
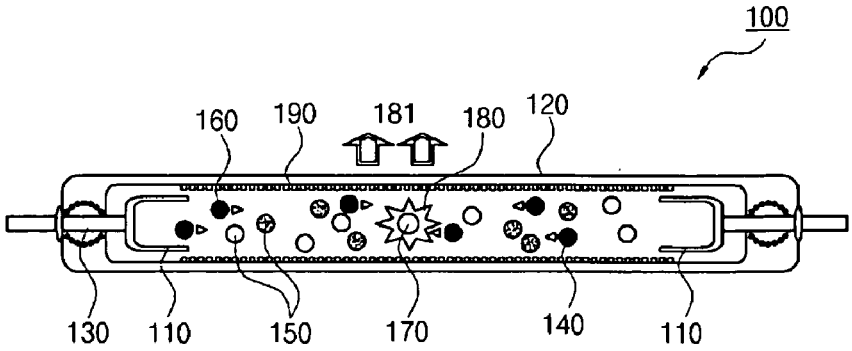

[Fig. 8]
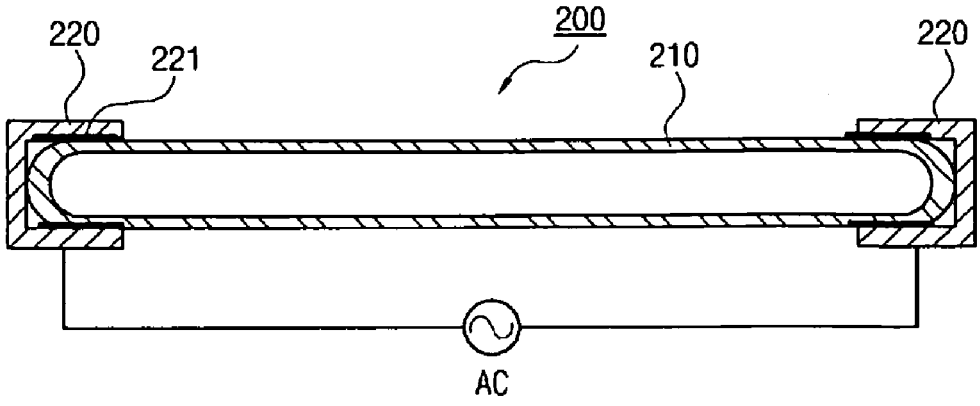

FLUORESCENT LAMP HAVING CERAMIC-GLASS COMPOSITE ELECTRODE

TECHNICAL FIELD

The present invention relates to a fluorescent lamp including a ceramic-glass composite as an electrode. More particularly, the present invention relates to a fluorescent lamp, which is able to maximize the emission of secondary electrons occurring upon the collision of ions in plasma, mercury ions, or electrons in a vacuum discharge tube, to thus exhibit higher brightness than conventional fluorescent lamps.

BACKGROUND ART

As an example of a conventional TFT-LCD backlight, a cold cathode fluorescent lamp 100 is illustrated in FIG. 7. In the fluorescent lamp 100, a glass tube 120, which includes a pair of cup-shaped metal electrodes 110 inserted thereinto, is melt-sealed at both ends thereof using respective lead-in wires 130 having the same thermal expansion coefficient as that of the glass tube. Upon the fabrication of the lamp, even though the lamp is exhausted to a high vacuum level, primary electrons, naturally occurring due to cosmic rays, are present therein. In the lamp fabrication process, after evacuation, the lamp is filled with Ne—Ar gas 150 at a pressure of 50 torr or more. When alternating current of high voltage is applied to both ends of the lamp, the primary electrons are accelerated by the electrical field, thus ionizing the gas 150. When such ionization continues, spark plasma, in which cations 160 and negative electrons 140 coexist, is formed. The formed cations and electrons collide with both of the metal electrodes 110, and thus are neutralized. In this case, secondary electrons are generated from the metal electrodes due to collisions, thereby making continuous discharge possible. Thus, the generation of secondary electrons is regarded as an important factor in realizing continuous light emission. As the emission of secondary electrons is facilitated, high brightness is maintained.

When the electrons in the plasma collide with neutral mercury atoms 170, the mercury atoms 170 are excited. When the excited mercury atoms 170 return to a ground state, UV light 180 is emitted. The emitted UV light 180 is incident on a phosphor 190 applied on the inner wall of the lamp tube, and is thus converted into visible light 181. As such, the electrons 140 or cations 160, colliding with the metal electrodes, create sputtering at the electrodes. The metal electrode component, scattered through sputtering, is bound to mercury, thus forming a compound. When this compound is deposited around the electrodes, blackening occurs, which results in a decreased lifetime. The problem of the decreased lifetime is a big problem with the cold cathode fluorescent lamp.

In order to overcome this problem, there have been proposed 1) a method of decreasing the discharge initiation voltage using penning effects depending on the excitation and ionization of the neon-argon gas 150 loaded into the lamp, to thus reduce the impulse of electrons 140 or cations 160 colliding with the metal electrodes 110, thereby diminishing the generation of sputtering, and 2) a method of decreasing the discharge initiation voltage by dropping the gas pressure as low as possible.

However, in the cases of 1) and 2), when the discharge initiation voltage is low, the kinetic energy of the cations 160 or electrons 140 colliding with the metal electrodes 110 is decreased, undesirably reducing the emission of secondary electrons from the metal electrodes 110, resulting in decreased brightness.

In order to overcome this problem, there has been proposed 3) a method of selectively using a material having a low work function as that of the material for the metal electrode 110, to thus facilitate the supply of electrons from the metal electrode 110. However, in the case of 3), the fabrication cost is raised because the price of the metal electrodes 110 is high. Further, there is a problem in which expensive borosilicate glass must be used in order to adjust the thermal expansion coefficients of the glass tube 120 and the lead-in wire 130. Whereas the cold cathode fluorescent lamp 100 has low tube resistance, the resistance component thereof is dominantly large, and thus one transformer is responsible for driving only one lamp, inevitably incurring an increase in the total fabrication cost. Moreover, as the diameter of the tube is increased, brightness is drastically decreased, so that the lamp is required to be mechanically strong. Ultimately, it is difficult to apply the above lamp to large-sized TVs requiring a lamp having a large diameter (tube diameter: 4 mm or larger) as a backlight.

In order to partially solve the problem, there has been developed an external electrode fluorescent lamp, in which the outer surfaces of both ends of a glass tube are coated with a conductor, or are brought into close contact with a metal cap, to thus enable parallel driving using a capacitance component of glass, which is illustrated in FIG. 8.

In the external electrode fluorescent lamp 200 of FIG. 8, phosphor is applied on the inner surface of a glass tube 210, both ends of which are sealed. The inner space of the glass tube 210 is filled with a charge gas mixture comprising inert gas, such as argon (Ar) or neon (Ne), and mercury (Hg) gas. Further, an external electrode having one of various shapes, coated with a conductive layer 221 including silver or carbon, is provided at each of both ends of the glass tube 210, and is fitted with a metal cap 220.

As for the external electrode fluorescent lamp 200, when high voltage alternating current (AC) is applied to the conductive layer 221, both ends of the glass tube 210, in contact with the external electrodes 220, play a role as a dielectric material, leading to a strong induced electric field. More specifically, when the polarity of the voltage applied to the external electrode is (+), electrons accumulate in the glass tube coated with the conductive layer. On the other hand, when the polarity thereof is (−), cations accumulate. The wall charges accumulated through continuous polarity conversion using the alternating current electric field reciprocate between the opposite ends of the glass tube. As such, while the wall charges collide with the mercury gas that is supplied together with the inert gas, the excited light emission of the mercury gas is induced. Then, UV light, produced during this emission, excites the phosphor applied on the inner wall of the glass tube, thereby causing it to emit visible light.

Further, the UV light thus radiated excites the phosphor applied on the inner wall of the glass tube 210. Accordingly, when light is emitted from the inner space of the glass tube 210, light is radiated externally.

In the conventional external electrode fluorescent lamp 210, as the areas of both ends of the glass tube 210, functioning as the dielectric material, to be coated with the conductive layer 221, are enlarged, the magnitude of wall charges is increased, whereby the brightness of the lamp may be increased to some degrees. However, there is a limitation in the ability to extend the conductive layer 221 in a longitudinal direction. In the case where the conductive layer 221 extends in a longitudinal direction, the area in which light is externally radiated is decreased, undesirably reducing the emission efficiency.

DISCLOSURE OF INVENTION

Technical Problem

Accordingly, the present invention has been made to solve the above problems occurring in the related art, and an object of the present invention is to provide a fluorescent lamp having ceramic-glass composite electrodes, which has a high dielectric constant, high secondary electron emission, and high polarization under the same electric field, and thus enables the movement of many more electrons and cations, resulting in high brightness.

Another object of the present invention is to provide a fluorescent lamp having ceramic-glass composite electrodes, a dielectric constant of which has superior temperature stability, and thus there is no brightness variation even in response to changes in the external environment.

A further object of the present invention is to provide a fluorescent lamp having ceramic-glass composite electrodes, having the composition of a glass additive in the ceramic-glass composite to easily adjust the thermal expansion coefficient, thereby preventing failure due to a difference in thermal expansion coefficient.

Still a further object of the present invention is to provide a ceramic-glass composite electrode having constant capacitance, in which the electrode is formed in a hollow cylindrical shape having a stepped portion to limit the length of the electrode inserted into the fluorescent lamp.

Technical Solution

In order to achieve the above objects, the present invention provides a fluorescent lamp having ceramic-glass composite electrodes, which has the following configuration.

The fluorescent lamp having ceramic-glass composite electrodes includes a glass tube, which has a phosphor applied on the inner surface thereof and is filled with a mixture of inert gas and metal vapor, and both ends of which are sealed; and hollow cylindrical electrodes provided at both ends of the glass tube, in which each of the hollow cylindrical electrodes has a stepped portion between a central portion thereof and an end portion thereof, and is formed of a ceramic-glass composite.

In the present invention, the stepped portion of the electrode may be formed in a manner such that the inner diameter of the central portion thereof is smaller than that of the end portion thereof, thus making the central portion thicker. The ceramic-glass composite electrode may have a conductive layer formed on the outer surface thereof, and the end portion thereof may be connected to the glass tube using a sealing glass paste.

The electrode of the present invention may be typically formed by subjecting ceramic-glass composite powder to injection molding or pressing. The requirements for the electrode material are as follows.

The ceramic composition composed of MgO—CaO—$TiO_2$ or CaO—MgO—SrO—$TiO_2$—$ZrO_2$ should have a phase transfer temperature of −30° C. or lower, and thus should not break upon connection to the glass tube, due to a drastic change in thermal expansion coefficient resulting from the change in crystalline structure at a temperature of 400~600° C., at which the sealing glass paste is burned. Further, when the fluorescent lamp is used in low-temperature areas, the ceramic-glass composite electrode and the glass tube of the lamp should not break due to the phase transfer phenomenon. In addition, the composition should be present in a monocrystalline structure at −30° C., which is a minimum temperature for use, and above. In addition, to increase the charge-discharge amounts of ions and electrons, the composition should have a dielectric constant greater than that of glass (having a dielectric constant of 10~15). In addition, the ceramic composition should have greater polarization in an electric field, even at the same dielectric constant.

The ceramic material thus selected may be added with glass frit, in order to decrease the difference in thermal expansion coefficient from that of the glass tube and to minimize the generation of sputtering at the grain boundary of the ceramic material.

As the electrode material satisfying the above requirements, in the present invention, a composite comprising a CaO—MgO—SrO—$ZrO_2$—$TiO_2$ ceramic composition and glass frit may be used. This glass frit is preferably added in an amount of 0.3~10 wt % based on the total amount of the ceramic composition.

The CaO—MgO—SrO—$ZrO_2$—$TiO_2$ ceramic composition may include a basic composition comprising CaO in a range of $0<CaO<1$ mol, MgO in a range of $0<MgO<1$ mol, SrO in a range of $0<SrO<1$ mol, $ZrO_2$ in a range of $0<ZrO_2<1$ mol, and $TiO_2$ in a range of $0<TiO_2<1$ mol, in which CaO+MgO+SrO:$ZrO_2$+$TiO_2$ has a molar ratio of 1:1, and may further include 3 wt % or less of one or more selected from the group consisting of MnO, $Al_2O_3$, $Cr_2O_3$, and $Fe_2O_3$, based on the total amount thereof.

The MgO—SrO component of the composition may be replaced with oxide having a difference in ion radius of 15% or less.

Advantageous Effects

According to the present invention, the fluorescent lamp having ceramic-glass composite electrodes has the following advantages compared to conventional external electrode lamps.

First, the fluorescent lamp of the present invention has a dielectric constant much higher than glass having a dielectric constant of about 10, and has high secondary electron emission. Furthermore, polarization thereof under the same electric field is at least 2 times that of glass. Thus, under conditions of the same electrode area and the same dielectric area, many more electrons and ions may be moved in the glass tube, thereby greatly increasing the brightness of the lamp.

Second, the temperature stability of dielectric constant is superior at temperatures of −30° C. and above. Thus, when the lamp is driven, brightness is maintained uniform even though the temperature is increased by the impulse of ions and electrons colliding with the electrodes. That is, there is no brightness variation even in response to changes in the external environment.

Third, the thermal expansion coefficient may be easily adjusted by changing the composition of the glass additive in the ceramic-glass composite. Therefore, when the lamp glass tube and the ceramic-glass composite electrode material are sealed through thermal treatment using a glass sealing material, failure due to the difference in thermal expansion coefficient therebetween may be prevented, which enables the stable fabrication of the lamp depending on the type of lamp tube.

Fourth, upon the fabrication of the lamp, the ceramic-glass composite electrode is formed to have a hollow cylindrical shape having a stepped portion to limit the length thereof inserted into the fluorescent lamp in order to uniformly control charge-discharge amounts. Thereby, a ceramic-glass composite electrode having constant capacitance may be obtained.

BRIEF DESCRIPTION OF THE DRAWINGS

FIG. 1A is a front cross-sectional view illustrating the fluorescent lamp having ceramic-glass composite electrodes according to a preferred embodiment of the present invention, before being sealed with sealing members, and FIG. 1B is a front cross-sectional view illustrating the fluorescent lamp having ceramic-glass composite electrodes according to the present invention, after being sealed with sealing members;

FIG. 2 is a graph illustrating the temperature stability of the dielectric constant according to the embodiment of the present invention;

FIG. 3A is a top plan view illustrating the ceramic-glass composite electrode of the present invention, and FIG. 3B is a front cross-sectional perspective view illustrating the ceramic-glass composite electrode of the present invention;

FIG. 4 is a graph illustrating the change in brightness depending on the dielectric constant when using the electrode material having the composition of Table 1;

FIG. 5 is a graph illustrating the change in polarization depending on the applied electric field when using a conventional external electrode, composed exclusively of glass and the electrodes having the compositions of Table 1 of the present invention;

FIG. 6 is a graph illustrating the determination of hysteresis % from the graph of FIG. 5;

FIG. 7 is a cross-sectional view illustrating a conventional cold cathode fluorescent lamp used as a TFT-LCD backlight; and FIG. 8 is a cross-sectional view illustrating another conventional external electrode fluorescent lamp.

MODE FOR THE INVENTION

Hereinafter, a detailed description will be given of the present invention in conjunction with the drawings.

FIGS. 1A and 1B are cross-sectional views illustrating the structure of a lamp 400, according to the present invention. FIG. 1A illustrates the lamp 400 before it is sealed with sealing members 420, and FIG. 1B illustrates the lamp 400 after it is sealed with sealing members 420. As illustrated in FIGS. 1A and 1B, the lamp 400 includes a lamp body 410, sealing members 420, and electrodes 430.

The lamp of the present invention includes the lamp body 410 having an inner space to be filled with gas, sealing members 420 positioned at both ends of the lamp body for sealing the ends of the lamp after the completion of gas charge, and opposite ceramic-glass composite electrodes 430, respectively having one side connected to the lamp body 410 and the other side connected to the sealing member 420.

The lamp body 410 may have a tube shape, a U-shape, or a rectangular shape. In FIGS. 1A and 1B, the exemplary lamp body 410 has a tube shape. The lamp body 410 may be formed of borosilicate, Pb-free glass, or quartz glass.

The sealing members 420, which are positioned at both ends of the lamp body 410, function to seal the ends of the lamp after the gas is loaded into the lamp. FIG. 1A illustrates the lamp 400 before it is sealed with the sealing members 420, and FIG. 1B illustrates the lamp 400 after it is sealed with the sealing members 420.

As illustrated in FIGS. 3A and 3B, the electrode 430 is structured such that one side of the electrode is connected to the lamp body 410 and the other side thereof is connected to the sealing member 420. The electrode 430 has a hollow cylindrical shape having a stepped portion 431 so that it can be connected to the lamp body and to the sealing member. In the present invention, the lamp body 410 has an outer diameter of 3 mm and an inner diameter of 2.2 mm. Further, the electrode 430 has an outer diameter of 3.1 mm and an inner diameter of 2.2 mm. Thus, the electrode is easily connected to the lamp 410 by a constant predetermined length, and the adhesion length of the glass tube may be maintained uniform. As the result, upon the fabrication of the lamp, it is possible to prevent the performance of the lamp from varying depending on the capacitance.

The electrode 430 preferably has a dielectric constant of 20 and above. As a material for the electrode 430, particularly useful is a phosphorus ceramic-glass composite, the dielectric constant of which has superior temperature stability, or a ceramic-glass composite having no phase transfer point at −30° C. or higher. Further, silver or carbon may be attached to the outer surface of the electrode 430. The electrode is formed through a powder injection molding process or a dry press process using the ceramic-glass composite.

On all inner walls of the glass tube 410 and the sealing members 420 of the lamp 400, except for the ceramic-glass composite electrode, phosphor is applied. Gas that is loaded into the lamp includes neon (Ne), argon (Ar), and mercury gas. Instead of the mercury gas, xenon (Xe) gas may be used.

The ceramic-glass composite of the electrode 430 preferably includes molten glass having high sputtering resistance such as a glass frit. Here, the term "sputtering" indicates a phenomenon in which the inner portion of the ceramic-glass composite electrode present in the lamp tube is damaged, attributable to the collision of inert elements, such as argon cations, mercury ions, or electrons against the inner wall of the electrode.

The lamp 400 may include a glass sealing material for connecting the electrode 430 to the lamp body 410 and to the sealing member 420. As such, it is preferred that the thermal expansion coefficient of the glass sealing material be intermediate of those of the glass tube 410 and the ceramic-glass composite electrode 430. The thermal treatment temperature for sealing should not be higher than the softening point of the glass tube. Further, the thermal treatment for sealing is carried out by applying the glass sealing material on both ends of the glass tube 410 and on the sealing members 420, inserting the ceramic-glass composite electrodes 430 and the sealing members 420, and conducting the treatment at 500° C., before conducting evacuation and gas loading.

The lamp 400 is formed of Pb-free glass having a thermal expansion coefficient similar to that of the ceramic-glass composite. The gas loaded into the lamp 400 includes neon (Ne), argon (Ar), and mercury gas, but alternatively, xenon (Xe) gas may be used in place of mercury, depending on the need.

The gas is loaded into the lamp 400 as follows. That is, a vacuum pump is connected to both ends of the lamp 400 in the state of FIG. 1A to thus exhaust the lamp, after which gas, including neon, argon, and mercury, is loaded into the lamp. Subsequently, the lamp is sealed with the sealing members 420 using a heating process.

According to a first embodiment of the present invention, the electrode material has the following composition.

$$(CaO—MgO—SrO—ZrO_2—TiO_2)+\text{glass frit A} \qquad \text{Formula 1}$$

The dielectric constant and dielectric loss of the material of Formula 1, having the composition ratio shown in Table 1 below (samples EC1 to EC6), were measured at room temperature. The results are shown in Table 1 below.

TABLE 1

| Sample | Component (mol) CaO | MgO | SrO | $ZrO_2$ | $TiO_2$ | Dielectric Constant | Dielectric Loss % |
|---|---|---|---|---|---|---|---|
| EC1 | 0.65 | 0.05 | 0.3 | 0.97 | 0.03 | 32.3 | 0.19 |
| EC2 | 0.65 | 0.05 | 0.3 | 0.9 | 0.1 | 38.2 | 0.1 |
| EC3 | 0.65 | 0.05 | 0.3 | 0.8 | 0.2 | 51.1 | 0.12 |
| EC4 | 0.65 | 0.05 | 0.3 | 0.7 | 0.3 | 66.2 | 0.15 |
| EC5 | 0.65 | 0.05 | 0.3 | 0.6 | 0.4 | 84.8 | 0.12 |
| EC6 | 0.65 | 0.05 | 0.3 | 0.5 | 0.5 | 105.1 | 0.25 |

As the glass frit additive, Pb-free glass SF-44 for a lamp tube was used. Because the thermal expansion coefficient thereof was $95\times10^{-7}$/K, the thermal expansion coefficient was adjusted by adding 0.6 mol BaO and 0.4 mol CaO to 1 mol $SiO_2$, or alternatively, adding 0.3~10 wt % of glass frit, having the same composition as Pb-free glass based on the total amount of the sample, and then synthesizing the components at 1,100° C. As such, 3 wt % of MnO and $Al_2O_3$ were further added.

As is apparent from Table 1, as the amount of $TiO_2$ was increased, the dielectric constant was increased. Upon the fabrication of the fluorescent lamp, when an alternating current electric field of 1000 $V_{rms}$ or more is applied to the ceramic-glass composite having the present composition used as the electrode, heat generation is decreased in proportion to the decrease in dielectric loss. In this case, the dielectric loss was decreased to about 0.1% by the addition of MnO and $Al_2O_3$. Further, in order to increase the stability of the fluorescent lamp depending on the change in temperature, the dielectric constant of the ceramic-glass composite should have high temperature stability. The temperature stabilities of dielectric constants for respective compositions are graphed in FIG. 2.

In the graph, all of the electrode compositions can be seen to have a stable dielectric constant change in the temperature range from −30° C. to 250° C. Hence, it can be seen that temperature stability is increased when the dielectric constant is low. Thereby, the electrode composition according to the first embodiment of the present invention can be confirmed to have a dielectric constant higher than general glass, and thus the dielectric constant thereof exhibits superior temperature stability.

The performance of the fluorescent lamp using the ceramic-glass composite electrode having the above composition according to the first embodiment was compared to that of a conventional external electrode fluorescent lamp. To this end, fluorescent lamps having the same diameter and the same length were fabricated. Thereafter, current and voltage applied to both ends of the lamp were measured using a high-voltage probe and a current sensor available from Tektronix, after which brightness was measured using a BM-7A brightness meter. The results are shown in Table 2 below.

TABLE 2

| Lamp | Dimension: Outer Diameter*Total Length (mm) | Electrode Length (mm) | No. of Lighting Lamps | Input Power (watts) | Brightness (cd/m$^2$) |
|---|---|---|---|---|---|
| Conventional External Electrode Lamp | 8*360 | 15 | 2 | 9 | 5200 |

TABLE 2-continued

| Lamp | Dimension: Outer Diameter*Total Length (mm) | Electrode Length (mm) | No. of Lighting Lamps | Input Power (watts) | Brightness (cd/m$^2$) |
|---|---|---|---|---|---|
| Inventive Fluorescent Lamp (using EC1 electrode) | 8*360 | 15 | 2 | 16 | 22000 |

As is apparent from Table 2, the fluorescent lamp of the invention was fabricated using the EC1 electrode having the lowest dielectric constant according to the first embodiment to have the same electrode length as a conventional external electrode lamp. The input power of the conventional lamp was 9 watts, and the input power of the fluorescent lamp of the present invention was 16 watts, which is an increase of about 1.7 times. In addition, brightness was increased 4.2 times compared to the conventional external electrode lamp. The reason why the brightness is so high is considered to be that the dielectric constant of the ceramic-dielectric electrode of the present invention is about 2 times that of the conventional external electrode lamp, and also that the emission of secondary electrons is greater than in a conventional external electrode lamp. Further, because two lamps are driven using one inverter, parallel driving may be realized.

Using respective ceramic-glass composite electrodes, the change in brightness depending on the dielectric constant was determined. The results are shown in Table 3 below.

TABLE 3

| Lamp | Dimension: Outer Diameter*Total Length (mm) | Electrode Length (mm) | No. of Lighting Lamps | Input Power (watts) | Brightness (cd/m$^2$) |
|---|---|---|---|---|---|
| Conventional External Electrode Lamp | 8*360 | 15 | 2 | 9 | 5200 |
| Inventive Fluorescent Lamp | | | | | |
| EC1 | 8*360 | 15 | 2 | 16 | 22000 |
| EC2 | | | | | 22500 |
| EC3 | | | | | 23200 |
| EC4 | | | | | 26000 |
| EC5 | | | | | 27500 |
| EC6 | | | | | 31000 |

As is apparent from Table 3, when the input power is the same, brightness is increased in proportion to the increase in dielectric constant. To more easily depict this relationship, the relationship between dielectric constant and brightness is graphed in FIG. 4.

Furthermore, to compare the effects of the lamp having the electrodes according to the first embodiment with those of the conventional external electrode lamp, the properties of a conventional external electrode lamp for a 32-inch TFT-LCD TV backlight, presently commercially available, and of the fluorescent lamp of the present invention were compared. The results are shown in Table 4 below.

TABLE 4

| Lamp | Dimension: Outer Diameter*Total Length (mm) | Electrode Length (mm) | No. of Lighting Lamps | Input Power (watts) | Brightness (cd/m$^2$) |
|---|---|---|---|---|---|
| Conventional External Electrode Lamp | 4*720 | 25 | 2 | 15 | 9000 |
| Inventive Fluorescent Lamp | | | | | |
| EC1 | 4*720 | 15 | 2 | 28 | 32000 |
| EC2 | | | | | 33200 |
| EC3 | | | | | 36000 |
| EC4 | | | | | 42000 |
| EC5 | | | | | 45200 |
| EC6 | | | | | 52000 |

As is apparent from Table 4, the fluorescent lamp of the present invention can be seen to exhibit higher brightness than the conventional external electrode lamp.

As mentioned above, the lamp using the ceramic-glass composite electrode developed by the present invention can be seen to achieve high brightness of 3 times or higher even while realizing parallel driving, as in the conventional external electrode lamp.

According to a second embodiment of the present invention, as the ceramic-glass composite electrode, the following material composition is used.

$$(CaO—MgO—SrO—ZrO_2—TiO_2)+\text{glass frit B} \qquad \text{Formula 2}$$

The dielectric constant and dielectric loss of the electrode material of Formula 2, having the composition ratio shown in Table 5 below, were measured at room temperature. The results are shown in Table 5 below.

TABLE 5

| Sample | Component (mol): CaO | MgO | SrO | $ZrO_2$ | $TiO_2$ | Dielectric Constant | Dielectric Loss (%) |
|---|---|---|---|---|---|---|---|
| ECB1 | 0.65 | 0.05 | 0.3 | 0.97 | 0.03 | 25.0 | 0.12 |
| ECB2 | 0.65 | 0.05 | 0.3 | 0.9 | 0.1 | 28.0 | 0.1 |
| ECB3 | 0.65 | 0.05 | 0.3 | 0.8 | 0.2 | 41.0 | 0.12 |
| ECB4 | 0.65 | 0.05 | 0.3 | 0.7 | 0.3 | 54.0 | 0.15 |
| ECB5 | 0.65 | 0.05 | 0.3 | 0.6 | 0.4 | 65.4 | 0.12 |
| ECB6 | 0.65 | 0.05 | 0.3 | 0.5 | 0.5 | 88.5 | 0.13 |

As the glass frit additive, borosilicate for a lamp tube was used. Because the thermal expansion coefficient thereof was $33\times10^{-7}$/K, the glass frit component added to the ceramic-glass composite to adjust the thermal expansion coefficient was quantitatively composed of 75 wt % of $SiO_2$, 18 wt % of $B_2O_3$, 4 wt % of $Na_2O$, 2 wt % of $K_2O$, and 1 wt % of $Al_2O_3$. This glass frit was synthesized at 1100° C., and was then added in an amount of 0.3~10 wt % based on the total amount of the composition of Table 5. Further, MnO and $Al_2O_3$ were used as an additive. The amount of the additive was set to be 3 wt %.

The thermal expansion coefficient of the ceramic-glass composite electrode was determined to be $36\sim60\times10^{-7}$/K, which was gradually decreased in proportion to the increase in the amount of the glass additive. Further, the dielectric constant was determined to be different from that of Formula 1, depending on the types of glass frit component. Table 5 shows the dielectric constant and dielectric loss of each electrode composition upon the addition of 5 wt % of the glass frit B. As is apparent from Table 5, the higher the amount of $TiO_2$, the higher the dielectric constant. Upon the fabrication of the fluorescent lamp, when an alternating current electric field of 1000 Vrms or more is applied to the ceramic-glass composite having the electrode composition according to the second embodiment, heat generation is decreased in proportion to the decrease in dielectric loss. Hence, the dielectric loss was decreased to about 0.1% by the addition of MnO and $Al_2O_3$.

The lamp was fabricated through the method as in the first embodiment using the ceramic-glass composite electrode having the above composition, and the performance thereof was compared to that of a conventional external electrode lamp. The results are shown in Table 6 below.

TABLE 6

| Lamp | Dimension: Outer Diameter*Total Length (mm) | Electrode Length (mm) | No. of Lighting Lamps | Input Power (watts) | Brightness (cd/m$^2$) |
|---|---|---|---|---|---|
| Conventional External Electrode Lamp | 3*720 | 15 | 2 | 12 | 12000 |
| Inventive Fluorescent Lamp | | | | | |
| ECB1 | 3*720 | 15 | 2 | 22 | 41000 |
| ECB2 | | | | | 43200 |
| ECB3 | | | | | 46000 |
| ECB4 | | | | | 51500 |
| ECB5 | | | | | 54300 |
| ECB6 | | | | | 59000 |

As is apparent from Table 6, the fluorescent lamp formed of the ceramic-glass composite according to the second embodiment can be seen to be at least 3 times as bright as that of the conventional external electrode lamp, and to realize parallel driving. In the case where borosilicate is used as the glass tube of the fluorescent lamp, the glass component of the ceramic-glass composite is controlled, thereby adjusting the thermal expansion coefficient. Thus, when the glass tube and the fluorescent lamp are sealed through thermal treatment using the glass sealing material, a failure due to the difference in thermal expansion coefficient may be prevented, and furthermore, brightness may be increased.

To more specifically examine the reason why the brightness is increased according to the embodiment of the present invention, the polarization of each composition of Table 1, depending on the applied electric field, was measured. The results are shown in FIG. 5. With reference to FIG. 6, the hysteresis % is determined from the hysteresis curve of FIG. 5, showing the relationship between the applied electric field and the polarization. That is, as the hysteresis loss is increased, heat loss is increased under the alternating current electric field. Accordingly, stable driving may be realized when the hysteresis loss is low. The hysteresis loss may be determined using the following equation.

As illustrated in FIG. 6, when the maximum polarization at 10 kV/mm is indicated by $P_{max}$, and the difference in polarization at 0 kV/mm is indicated by $\Delta P$, the hysteresis loss is represented as follows.

$$\text{Hysteresis Loss (\%)}=\Delta P/P_{max}\times100$$

The hysteresis loss is determined using the data of FIG. 6 according to the above equation. The results are shown in Table 7 below.

TABLE 7

| | Glass | EC1 | EC2 | EC3 | EC4 | EC5 | EC6 |
|---|---|---|---|---|---|---|---|
| Hysteresis Loss (%) | 16 | 13 | 9 | 12 | 14 | 5.5 | 5.2 |

From these results, the fluorescent lamp of the present invention can be seen to exhibit relatively stable hysteresis loss even under a high electric field of 10 kV/mm, compared to the conventional glass electrode.

Therefore, the fluorescent lamp having the ceramic-glass composite electrodes of the present invention is characterized in that the ions or electrons present in the fluorescent lamp may be charged or discharged in amounts that are at least doubled upon the application of the same electric field, compared to the conventional external electrode lamp composed exclusively of glass. Further, the lamp of the present invention, having low hysteresis loss, can provide light at a stable temperature even under high voltage, compared to the conventional external electrode lamp composed exclusively of glass.

In the above embodiments, the MgO—SrO component may be replaced with oxide having a difference in ionic radius of 15% or less. Examples of the replaceable oxide are shown in Table 8 below.

TABLE 8

| Ion | Ion Radius (Å) | Replaceable Examples | Ion Radius (Å) | Δ Ion Radius (%) |
|---|---|---|---|---|
| $Ca^{2+}$ | 1.0 | $Y^{3+}$, $Yb^{3+}$ | 0.89, 0.86 | 11, 14 |
| | | $Sm^{2+}$ | 0.96 | 4 |
| | | $La^{3+}$ | 1.06 | 6 |
| | | $Nd^{3+}$ | 1.00 | 0 |
| $Mg^{2+}$ | 0.72 | $Bi^{2+}$ | 0.74 | 2.7 |
| | | $Li^{1+}$ | 0.74 | 2.7 |
| | | $Ni^{2+}$ | 0.69 | 3 |
| $Sr^{2+}$ | 1.16 | $Eu^{3+}$ | 0.59 | 15 |
| $Zr^{4+}$ | 0.72 | $Nb^{5+}$ | 0.64 | 11 |
| | | $Mo^{4+}$ | 0.65 | |
| | | $Fe^{2+}$, $Fe^{3+}$ | 0.77, 0.65 | |
| | | $Zn^{2+}$, $Sc^{3+}$ | 0.75, 0.73 | |
| | | $Mn^{2+}$ | 0.67 | |
| $Ti^{4+}$ | 0.61 | $Cr^{3+}$ | 0.62 | |
| | | $Sb^{5+}$ | 0.61 | |
| | | $Sb^{4+}$ | 0.69 | |
| | | $Nb^{5+}$ | 0.64 | |
| | | $Mn^{4+}$ | 0.54 | |

The invention claimed is:

1. A fluorescent lamp having ceramic-glass composite electrodes, comprising a glass tube, which has a phosphor applied on an inner surface thereof and is filled with a mixture of inert gas and metal vapor, both ends of which are sealed; and hollow cylindrical electrodes provided at both ends of the glass tube, wherein each of the hollow cylindrical electrodes has a stepped portion between a central portion thereof and an end portion thereof, and is formed of a composite of CaO—MgO—SrO—$ZrO_2$—$TiO_2$ ceramics and glass frit in an amount of 0.3~10 wt % based on a total amount of the ceramics, and the CaO—MgO—SrO—$ZrO_2$—$TiO_2$ ceramics comprise CaO in a range of 0<CaO<1 mol, MgO in a range of 0<MgO<1 mol, SrO in a range of 0<SrO<1 mol, $ZrO_2$ in a range of 0<$ZrO_2$<1 mol, and $TiO_2$ in a range of 0<$TiO_2$<1 mol, in which CaO+MgO+SrO:$ZrO_2$+$TiO_2$ has a molar ratio of 1:1, and further comprise one or more selected from a group consisting of MnO, $Al_2O_3$, $Cr_2O_3$, and $Fe_2O_3$, by 3 wt % or less based on a total amount thereof.

2. The fluorescent lamp according to claim 1, wherein the glass frit includes $SiO_2$:BaO:CaO at a molar ratio of 1:0.6:0.4.

3. The fluorescent lamp according to claim 1, wherein the glass frit comprises 75 wt % of $SiO_2$, 18 wt % of $B_2O_3$, 4 wt % of $Na_2O$, 2 wt % of $K_2O$, and 1 wt % of $Al_2O_3$.

4. The fluorescent lamp according to claim 1, wherein the ceramic-glass composite electrode has a conductive layer formed on an outer surface thereof, and the end portion thereof is connected to the glass tube using a sealing glass paste.

5. The fluorescent lamp according to claim 1, wherein the stepped portion of the electrode is formed in a manner such that an inner diameter of the central portion thereof is smaller than that of the end portion thereof, to thus make the central portion thicker.

6. The fluorescent lamp according to claim 1, wherein the MgO—SrO is replaced with oxide having a difference in ionic radius 15% or less compared with that of MgO—SrO.

7. The fluorescent lamp according to claim 1, wherein the ceramic-glass composite has no phase transition point at a temperature of not less than −30° C.

8. The fluorescent lamp according to claim 1, wherein the ceramic-glass composite has polarization value higher than that of glass which has maximum polarization value of 0.031 $\mu C/cm^2$ in an electric field of 10 kV/mm, and polarization curve thereof keeps linear dependency on electric field variation.

9. The fluorescent lamp according to claim 1, wherein the dielectric constant of the ceramic-glass composite is higher than that of glass and stays at a constant level or decreases as the temperature rises in a range from −30° C. to 250° C.

10. The fluorescent lamp according to claim 5, wherein the inner diameter of the central portion of the electrode is the same as that of the glass tube.

* * * * *